United States Patent [19]

Clairmont, Jr. et al.

[11] 4,408,575

[45] Oct. 11, 1983

[54] NOZZLE ASSEMBLY FOR CONTROLLED SPRAY

[75] Inventors: Floyd H. Clairmont, Jr., Peoria; Russell R. Graze, Jr., Dunlap, both of Ill.

[73] Assignee: Caterpillar Tractor Co., Peoria, Ill.

[21] Appl. No.: 278,511

[22] PCT Filed: Jan. 23, 1981

[86] PCT No.: PCT/US81/00092

§ 371 Date: Jan. 23, 1981

§ 102(e) Date: Jan. 23, 1981

[87] PCT Pub. No.: WO82/02575

PCT Pub. Date: Aug. 5, 1982

[51] Int. Cl.[3] ..... F01P 3/10

[52] U.S. Cl. ..... 123/41.35; 239/552

[58] Field of Search ..... 123/41.35; 239/533.12, 239/548, 552, 600, 601

[56] References Cited

U.S. PATENT DOCUMENTS

| | | | |
|---|---|---|---|
| 1,790,908 | 2/1931 | Fitts | 239/552 |
| 2,121,948 | 6/1938 | Borland | 239/552 |
| 2,321,017 | 6/1943 | De La Calle | 239/552 |
| 2,558,238 | 6/1951 | Collins | 239/552 |
| 3,221,718 | 12/1965 | Isley | 123/41.35 |
| 4,050,360 | 9/1977 | Powers et al. | 92/127 |
| 4,056,044 | 11/1977 | Kamman et al. | 92/159 |
| 4,067,307 | 1/1978 | Höfle et al. | 123/41.35 |
| 4,206,726 | 6/1980 | Johnson, Jr. et al. | 123/41.35 |

FOREIGN PATENT DOCUMENTS

| | | | |
|---|---|---|---|
| 1246919 | 10/1960 | France | 239/552 |

OTHER PUBLICATIONS

Caterpillar Tractor Co., Technical Information Release #18-480, dated Jun., 1980.

*Primary Examiner*—Craig R. Feinberg
*Assistant Examiner*—W. R. Wolfe
*Attorney, Agent, or Firm*—Anthony N. Woloch

[57] ABSTRACT

Nozzle assemblies are used to spray a liquid, for example oil, for cooling a reciprocating piston in an engine. Heretofore, the spray pattern has been undesirably divergent and this has proven to be a problem when spraying a long distance. The present nozzle assembly (10) maintains a substantially columnar spray pattern by having an inlet portion (40) defining an opening (46), and an outlet portion (42) defining a first passage (62) for communicating a first liquid flow from the opening (46) outwardly thereof at a first velocity, and a plurality of passages (66) for communicating a second liquid flow from the opening (46) outwardly thereof at a second velocity less than the first velocity. The passages preferably have a relatively significant L/D ratio.

1 Claim, 3 Drawing Figures

NOZZLE ASSEMBLY FOR CONTROLLED SPRAY

DESCRIPTION

1. Technical Field

This invention relates generally to a nozzle assembly for controllably spraying a liquid in a substantially columnar form and, more particularly, to a nozzle assembly for spraying a stream of cooling liquid into a reciprocating piston passage.

2. Background Art

In using a nozzle to spray a liquid, the pattern of the stream leaving the nozzle is important to assure that the liquid is delivered to the precise location desired. For example, a nozzle is commonly used to spray a cooling liquid such as engine oil upwardly against the piston as it reciprocates in order to cool it. In longer stroke engines particularly, the oil must be sprayed a relatively long distance toward the piston when it is at its top dead center position. The pattern of the spray is therefore important so that the oil reaches the desired portion of the piston for direct cooling. The oil can then drip or be deflected downwardly to cool the remaining portion of the piston.

Heretofore, the nozzle in such engines have utilized a single opening having a sufficiently large cross-sectional area to deliver the desired volume of oil for a given period of time. However, over the distances which the oil is directed, it tends to spread out or have an excessively wide spray pattern. This reduces the effectiveness of the cooling oil in that sufficient amounts do not reach the piston crown area.

One attempted experimental solution was to taper the outlet passageway in the nozzle to better concentrate the stream leaving the nozzle. However, the manifold construction and tapered nozzle imparted an undesirable rotation and turbulence to the oil particles so that an unacceptable diverging spray pattern still resulted.

The present invention is directed to overcoming one or more of the problems as set forth above.

DISCLOSURE OF INVENTION

In one aspect of the present invention, a nozzle assembly for controllably spraying a liquid in a columnar form has substantially axially aligned inlet and outlet portions, with the inlet portion defining an opening therethrough. First passage means is provided for communicating a first liquid flow from the opening through the outlet portion and outwardly thereof at a first velocity, and second passage means is provided for communicating a second liquid flow from the opening through the outlet portion and outwardly thereof along a plurality of paths generally encircling the first passage means and individually having a second velocity less than the first velocity.

In another aspect of the present invention, a nozzle assembly is provided for controllably spraying a cooling liquid toward a reciprocating engine piston in a precise spray pattern. More specifically, a straight passage is defined in the piston leading to an upper cooling chamber, and the nozzle assembly controllably sprays the cooling liquid in a columnar form into the passage and thereby to the chamber.

In yet another aspect of the present invention, a method is disclosed for spraying a liquid from a nozzle assembly. The steps of the method include initiating liquid flow through an opening in an inlet portion of the nozzle assembly, and controlling the liquid flow from the inlet portion at an outlet portion defining a primary, centrally located passage and a plurality of secondary, peripherally located passages such that the liquid exits from the primary passage at a first velocity and from the secondary passages at a second velocity to maintain a columnar spray pattern.

Advantageously, the liquid spray pattern of the present nozzle assembly is maintained in a columnar form rather than being widely dispersed. This is achieved by providing different liquid flow paths, such as centrally from a primary outlet passage and peripherally from a plurality of secondary outlet passages which cooperate to maintain the spraying pattern relatively compact and free from such dispersing effects.

Best Mode For Carrying Out the Invention

Figure 1:
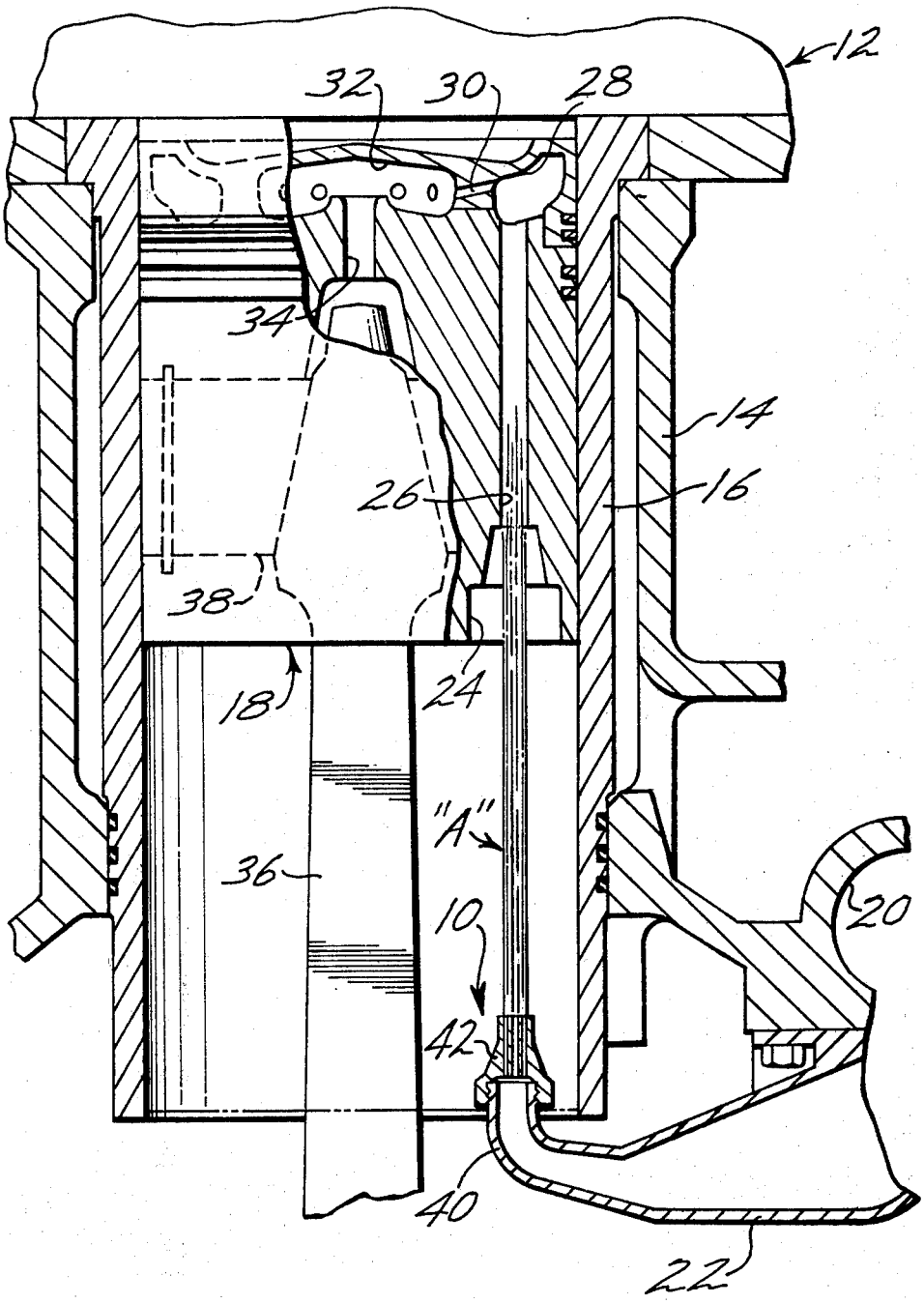
FIG. 1 is a diagrammatic elevational view of an engine with a portion broken open and sectioned showing one embodiment of the nozzle assembly of the present invention for spraying a cooling liquid in columnar form into a passage in a piston of the engine.

Referring to the drawings, and particularly to FIG. 1, a nozzle assembly 10 is shown associated with an internal combustion engine 12. The engine has a block 14 in which a cylinder liner 16 is carried. A piston 18 is positioned in the cylinder liner and reciprocates, as is known in the art, within the cylinder liner. The block 14 has a passageway 20, and a liquid distribution manifold 22 is releasably connected to the block in communication with the passageway. The nozzle assembly 10 receives a cooling liquid, such as engine oil, under pressure from the passageway and the manifold, which is then sprayed upwardly toward the piston as it reciprocates in a liquid column as is illustrated and identified by the letter "A".

The piston 18 has a profiled downwardly facing and stepped opening 24 and a straight passage 26 connected to the opening which extends upwardly to an internal annular chamber 28 located at the crown area thereof. A plurality of generally radially extending passages 30 serve to communicate cooling liquid in the annular chamber with a centrally disposed cavity 32. From the cavity the liquid can descend by gravity through a central port 34 to the region of the connection between the connecting rod 36 and pin 38 for lubrication thereof.

Figure 2:
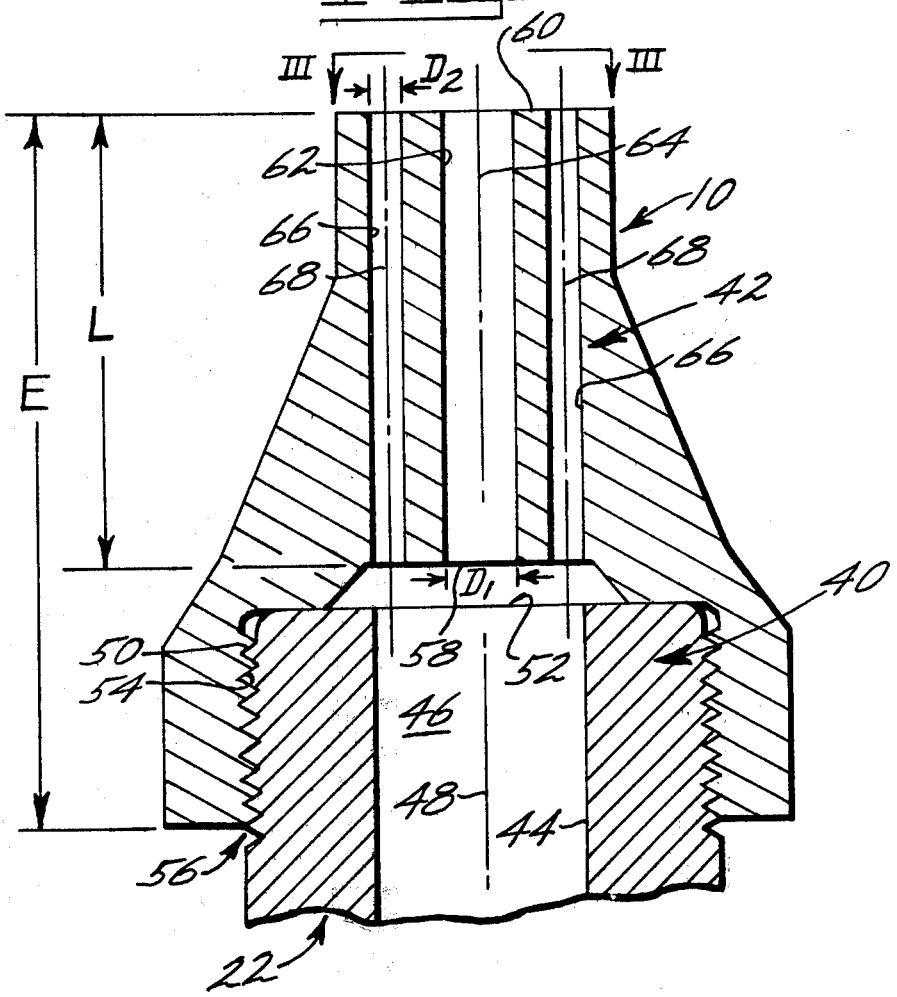
FIG. 2 is a diagrammatic and greatly enlarged cross-sectional view of the nozzle assembly of FIG. 1.

As best seen in FIG. 2, the nozzle assembly 10 generally includes an inlet portion 40 and an outlet portion 42 releasably secured thereon. In the instant example the inlet portion is an integral outlet part of the manifold 22 and has a substantially cylindrical inner wall 44 at the outlet thereof defining an opening 46 through which the cooling liquid flows generally along a first central axis 48. The inlet portion further has external connecting threads 50 and an end face 52, and the outlet portion has internal connecting threads 54 and a pocket 56 for screwthreadably receiving the inlet portion.

Figure 3:
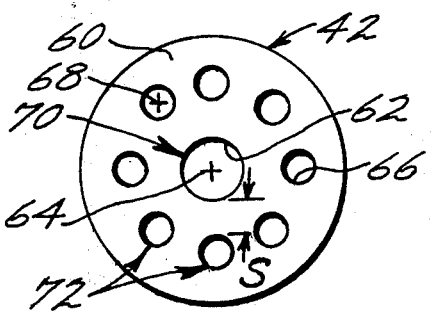
FIG. 3 is a diagrammatic, outlet end elevational view of the nozzle assembly taken along line III—III of FIG. 2.

The outlet portion 42 of the nozzle assembly 10 includes a planar inner end face 58 and a planar outer end face 60 parallel thereto defining a preselected length "L" therebetween as is illustrated in FIG. 2. More specifically, a cylindrical outlet passage 62 having a preselected diameter "$D_1$" is defined between the end faces and is disposed on a second central axis 64 generally aligned with the first central axis 48 of the inlet portion 40. Moreover, a plurality of cylindrical outlet passages 66 are also defined between the end faces and individually have a diameter "$D_2$". The passages 66 are preferably aligned along a plurality of individual axes 68 which are parallel to the central axis 64 and symmetrically located a radial disance therefrom to establish a radial separation distance "S" between the central passage 62 and the surrounding passages 66 as is illustrated in FIG. 3. It is theorized that the minimal radial separation distance "S" should be about 1 mm, or one half the diameter "$D_2$", whichever is greater.

Thus, the central outlet passage 62 constitutes a primary or first passage means 70 for communicating a first liquid flow from the opening 46 through the outlet portion 42, and the encircling passages 66 constitute a secondary or second passage means 72 for communicating a second liquid flow from the opening 46 through the outlet portion. Advantageously, the first liquid flow has a flow rate along the central axis 64 at a first velocity, and the second liquid flow has a flow rate in the individual passages 66 at a second velocity less than the first velocity.

The velocities of the individual outward liquid flow paths from the nozzle assembly 10 are at least in part based upon a relationship to the boundary layer flow conditions adjacent the inner wall 44 of the opening 46 in the inlet portion 40. As is known in the art, the boundary layer flow through a pipe, such as the manifold 22 might represent, is a region adjacent the wall of decreased liquid velocity owing to the viscous drag of the liquid thereat.

In the nozzle assembly 10, the primary outlet passage 62 is spaced radially inwardly of the axial extension of the boundary layer within opening 46 in order to achieve the first desired velocity. Where the outlet passage is positioned centrally as shown, such first velocity will basically be the highest velocity through the inlet portion 40 and the highest velocity through the nozzle assembly. The reduced second velocity desired from the secondary outlet passages 66 is established in the instant embodiment by locating them at least in part in substantial axial alignment with the boundary layer flow along the inner wall 44. This can be accomplished by positioning the radially outermost portion of the secondary outlet passages 66 in axial alignment with the inner wall 44 of the opening 30. In other words, the radially outer edges of the peripherally grouped outlet passages are constructed axially flush with the inner wall such that liquid at a decreased velocity will enter the secondary outlet passages.

It should be understood that the nozzle assembly 10, and particularly the outlet passages 62, 66 can be of other configurations without departing from the invention. For example, the outlet passages can be formed of individual tubes, not shown, attached to the inlet portion 40. Also, the shape, orientation, number and size of the outlet passages can be varied as long as the cross-section thereof is basically symmetrical to assure columnar flow. For another example, a plurality of arcuately shaped outlet passages, not shown, can be formed in an annular relationship about the primary outlet passage. However, it is believed that the illustrated configuration represents the most desirable and economical nozzle assembly contemplated.

INDUSTRIAL APPLICABILITY

In use, the nozzle assembly 10 sprays a substantially columnar stream pattern "A" upwardly into the profiled opening 24 and the passage 26 formed in the reciprocating piston 18. Whereupon the oil enters the annular chamber 28 substantially at the same flow rate as it had leaving the nozzle assembly. In other words, the oil stream makes substantially no contact with the walls of the opening 24 so that there is no loss of cooling oil before the stream enters the interior of the passage 26. When the piston is at bottom dead center as is indicated by the phantom line in FIG. 1, the outlet portion 42 of the nozzle assembly is telescopingly received in the profiled opening 24 in the piston with but a minimum of clearance. But when it is at top dead center as shown, the stream is delivered for the greatest distance in columnar form directly into the passage 26.

It has been found that the use of multiple elongate passages 66 encircling the elongate central passage 62 greatly reduces any rotational turbulence of the oil in the inlet portion 40 of the manifold 22. This is in part due to the relatively significant ratio of the length "L" of the outlet passages 62, 66 to the cross-section areas thereof as represented by the respective diameters $D_1$ and $D_2$. It is theorized that the L/D ratio for the central passage 62 should preferably be in a range of from about 3.75 to about 6.0. Similarly, the L/D ratio for the outer passages 66 should preferable be in a range of from about 7.5 to about 13.0. It is further theorized that these two L/D ratios are related and should preferably not be less than 2:1 or greater than 3:1, and with the minimum individual ratio being above about 3.75.

In one preferred embodiment the distance "L" was 15 mm, $D_1$ was 2.5 mm, $D_2$ was 1.15 mm, and the radial distance "S" between the central passage and the eight peripherically located passages was 1 mm.

A sufficient quantity of oil must be available within a preselected pressure range above a minimum value of about 140 KPa in the inlet manifold 22. For example, in one instance oil under a pressure of about 480 KPa was available in the manifold sufficient for the subject nozzle assembly 10 to desirably supply about 18 liters/minute to the piston passage 26. Even though the oil in the manifold was in a fluid vortex state at the inlet portion 40 of the nozzle assembly, the plurality of relatively long straight passages 62, 66 served to divide the swirling flow into a plurality of individual and straightened streams. Due to the viscosity of the air medium between the central stream and the plurality of encircling streams traveling at a lesser velocity than the central stream, the outlying streams have a tendency to be pulled radially inwardly toward the central axis 64 through a suction phenomena aided by atmospheric pressure, all of which factors maintain the liquid stream pattern "A" in columnar form for a substantially significant overall distance, for example about 400 mm.

It is also to be noted that space is at a premium in the interior of an engine, so that it was desired to maintain the overall length "E" of the outlet portion 42 in FIG. 2 to below 25 mm in order to assure sufficient operating clearance from the piston 18.

Thus it is apparent that the nozzle assembly of the present invention is relatively compact and simple in operation, and can advantageously direct a columnar stream of oil into a linear passage in a reciprocating piston so that it can cool the crown portion thereof. This is accomplished without resorting to a complicated series of pressurized oil passages through the crankshaft and connecting rod, which costly alternative also tends to weaken these components in relatively critical areas.

Other aspects, objects and advantages of this invention can be obtained from a study of the drawings, the disclosure and the appended claims.

We claim:

1. In a nozzle assembly (10) adapted for controllably spraying a cooling liquid toward the underside of a reciprocating engine piston (18), the piston (18) defining an upper annular chamber (28) and a vertical passage (26) connected to the chamber (28), said nozzle assembly (10) having an inlet portion (40) which includes an inner circular wall (44) defining a straight cylindrical opening (46) therethrough, an outlet portion (42) adapted to be connected to said inlet portion (40) comprising:

said outlet portion (42) having a central straight cylindrical primary outlet passge (62) of a length (L) and of a uniform circular cross-sectional diameter ($D_1$) which is less than the cross-sectional diameter of the inlet portion opening (46), the primary outlet passage (62) being positionable for axial alignment with the opening (46) and adapated to communicate a first liquid flow from said opening (46) through the outlet portion (42) and outwardly thereof at a first velocity alignably into the passage (26) and upper chamber (28) of the piston (18), said outlet portion (42) further including a plurality of straight cylindrical secondary passages (66) axially parallel with and symmetrically encircling the primary outlet passage (62), the secondary passages (66) each being of the same axial length (L) and having a preselected uniform circular cross-sectional diameter ($D_2$), said secondary passages (66) positioned so that their radially outer edges are adpated to be flush with the inner wall (44) of the inlet portion opening (46) and the radially inner edges of said secondary passages (66) are equally spaced a preselected radial separation distance (S) from the periphery of the primary outlet passage (62), the radial separation distance (S) being at least equal to one half of $D_2$, the first ratio of $L/D_1$ falling within a range of 3.75 to 6.0 and the second ratio of $L/D_2$ falling within a range of 7.5 to 13.0, the secondary passages (66) adapated to communicate a plurality of second liquid flows from said opening (46) through the outlet portion (42) and outwardly thereof alignably into the passage (26) and upper chamber (28) of the piston (18) at a second velocity less than said first velocity so that the first and second liquid flows combine outside of the nozzle assembly (10), form, and maintain a substantially columnar and diametrically compact liquid spray pattern (A).

* * * * *

UNITED STATES PATENT AND TRADEMARK OFFICE

CERTIFICATE OF CORRECTION

PATENT NO. : 4,408,575

DATED : October 11, 1983

INVENTOR(S) : Floyd H. Clairmont, Jr., et al.

It is certified that error appears in the above-identified patent and that said Letters Patent are hereby corrected as shown below:

Column 3, line 10, change "disance" to --distance--.
Column 5, line 19, change "passge" to --passage--.
Column 5, line 24, change "adapated" to --adapted--.
Column 6, line 9, change "adpated" to --adapted--.
Column 6, line 18, change "adapated" to --adapted--.

Signed and Sealed this

*Fourteenth* Day of *February 1984*

[SEAL]

*Attest:*

GERALD J. MOSSINGHOFF

*Attesting Officer*

*Commissioner of Patents and Trademarks*